US007360930B2

(12) United States Patent
Yu

(10) Patent No.: US 7,360,930 B2
(45) Date of Patent: Apr. 22, 2008

(54) ELECTRONIC CANDLEHOLDER

(76) Inventor: Shung-Lun Yu, 3F-1, No. 14, Lane 54, Sec. 3, Hsin Sheng S. Rd., Taipei (TW)

( * ) Notice: Subject to any disclaimer, the term of this patent is extended or adjusted under 35 U.S.C. 154(b) by 110 days.

(21) Appl. No.: 11/426,020

(22) Filed: Jun. 23, 2006

(65) Prior Publication Data

US 2007/0297185 A1 Dec. 27, 2007

(51) Int. Cl.
*F21V 21/00* (2006.01)

(52) U.S. Cl. ..... 362/392; 362/276; 362/802

(58) Field of Classification Search ..... 362/161, 362/181, 394; 431/253, 289
See application file for complete search history.

(56) References Cited

U.S. PATENT DOCUMENTS 3,890,085 A * 6/1975 Andeweg ..... 431/125
5,015,175 A * 5/1991 Lee ..... 431/253
5,536,196 A * 7/1996 Sternberg ..... 446/81
6,050,812 A * 4/2000 Chuang ..... 431/253
6,443,589 B1 * 9/2002 Lee ..... 362/101
6,619,811 B2 * 9/2003 Wang et al. ..... 362/101
6,808,388 B2 * 10/2004 Lee ..... 431/253
6,960,076 B2 * 11/2005 Yu ..... 431/253
7,232,237 B2 * 6/2007 Bigger ..... 362/154

* cited by examiner

*Primary Examiner*—Ali Alavi
(74) *Attorney, Agent, or Firm*—Pai Patent & Trademark Law Firm; Chao-Chang David Pai

(57) ABSTRACT

An electronic candleholder includes a cup, a set of electronic installation containing a functional circuit, and a candleholder, in which decoration items may be placed. The functional circuit is activated in two phases, wherein a toggle switch in the form of an expansion press lever is disposed to activate phase one conduction when the cup is filled with a certain amount of candle; and a photosensitive switch or a slide switch is disposed to activate phase two conduction. The functional circuit is cut off once the candle is consumed to a certain extent. Light produced by a light emitting device is allowed to transmit through the interior of the candleholder to create unique effects.

10 Claims, 8 Drawing Sheets

ELECTRONIC CANDLEHOLDER

BACKGROUND OF THE INVENTION (a) Field of the Invention

The present invention is related to an electronic candleholder, and more particularly to one which operates on changed weight of a cup and a photosensitive switch to close or open an electronic circuit and allows rainbow lights to transmit downward through the candleholder in creating more harmonious visual effects.

(b) Description of the Prior Art

Combination of electronic candle and candleholder of the prior art generally has built in the base of the candleholder a light emitting or sound giving electronic installation to create visual or audio effects; and a slide switch is disposed at a preset location on the base of the candleholder to control the on/off of the light emitting or sound giving function of the circuit device. Therefore, when the electronic candleholder functions as a decoration item on the dining table, it totally relies upon manual control and it fails to achieve automatic switching on or off of the visual or audio functions.

Furthermore, since the electronic installation is built in the base of the candleholder of the prior art, the top and the bottom of the candleholder emit the light at the same time once the candle is lighted; as a result, the projection from the light source appears to be in discord and compromises the vision and sense of aesthetics.

SUMMARY OF THE INVENTION

The primary purpose of the present invention is to provide an electronic candleholder including a cup, a set of electronic installation, and a candleholder. The cup is disposed at the top of the candleholder; a toggle switch is provided between the cup and the electronic installation; once a proper amount of the candle liquid is filled into the cup, the weight of the cup triggers on the toggle switch to automatically complete phase one conduction of the function of the electronic installation; followed with the phase two conduction when later the candle is lighted without relying upon manual operation; and finally, when the candle liquid is consumed up to a certain extent, the cup loses some of its weight and the functional circuit is automatically cut off to stop audio/visual effects. Accordingly, the present invention permits more agile operation by controlling the on/off timing of the use.

Another purpose of the present invention is to provide an electronic candleholder that allows the light from the light source to project brilliantly in a desirable direction so that a more harmonious and aesthetic effect can be achieved since both of the cup and the electronic installation are disposed at the top of the candleholder to permit the light emitted from the electronic installation to freely transmit downward into the interior of the candleholder.

In the present invention the toggle switch disposed between the cup and the electronic installation includes an expansion press lever that is capable of detecting the change of weight of the cup. When the cup puts on weight by addition of candle liquid, the expansion press lever is pressed to activate the functional circuit of the electronic installation to complete phase one conduction; followed with phase two conduction in conjunction with a photosensitive switch to allow the rainbow light emitted from the electronic installation to transmit into the interior of the candleholder; and finally when the candle liquid is consumed to a certain extent to reduce its weight in the cup, the expansion press lever restores to its non-conduction status to automatically cut off the functional circuit of the electronic installation.

Another feature of the present invention is that the candleholder relates to a hollow body without restricting its inner or outer form or the material selected to contain decoration items as desired to further improve visual attraction results.

Another feature of the present invention is that a slide switch is disposed in parallel with the photosensitive switch of the electronic installation to serve as a switch to complete phase two conduction. The slide switch having a shape of a handle is mounted on a slot preset in the cup so that the handle of the slide switch can be driven by turning the cup for on/off operation of the slide switch.

Furthermore, the candleholder is provided with a base and a loudspeaker disposed in the base; the on/off operation of the loudspeaker is controlled by another set of photosensitive device or another manual switch. Accordingly the loudspeaker sounds once the light transmits downward through the base of the candleholder to create audio and video effects at the same time.

DETAILED DESCRIPTION OF THE PREFERRED EMBODIMENTS

Figure 1:
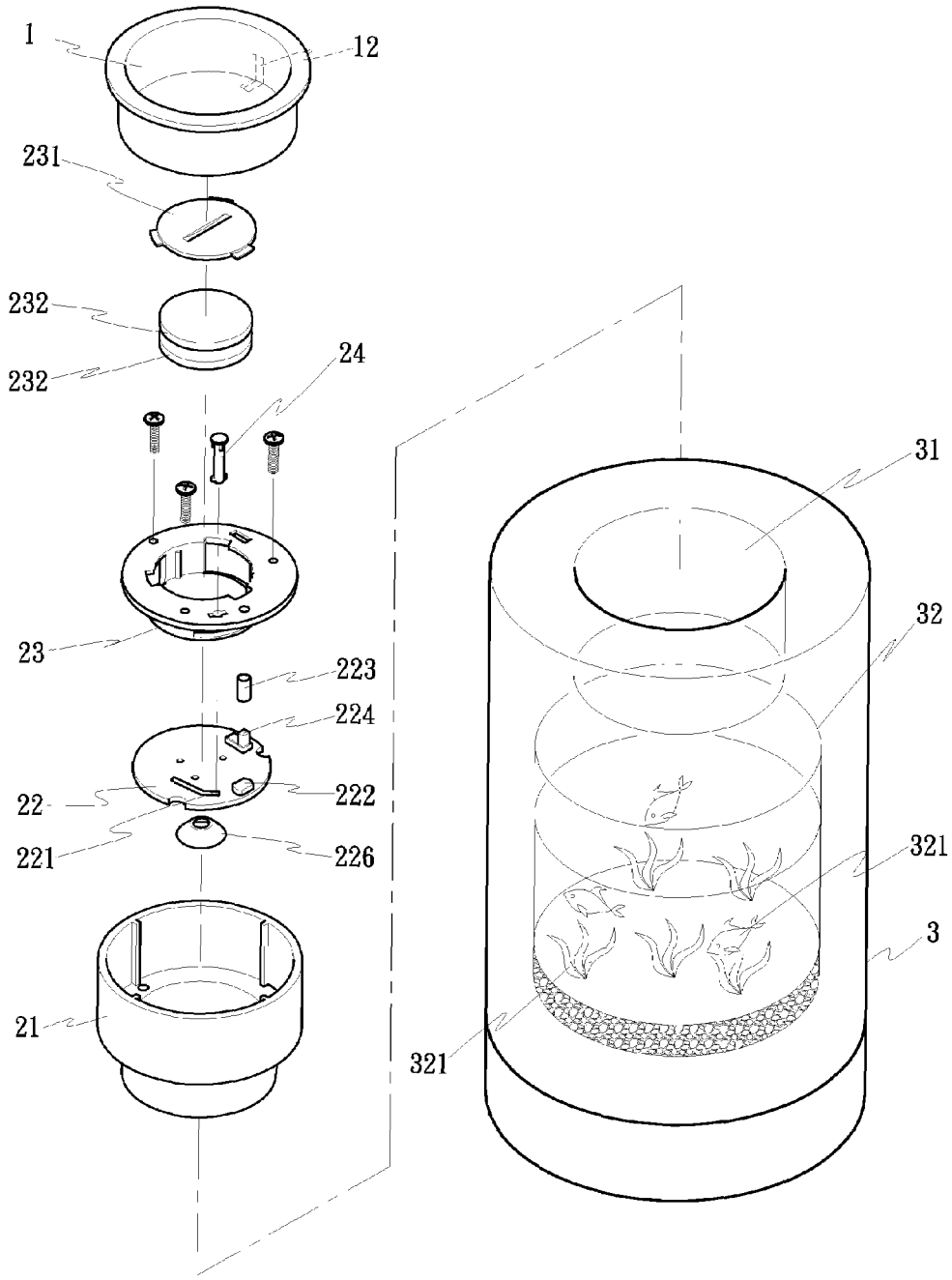
FIG. 1 is an exploded view of the present invention.
Figure 2:
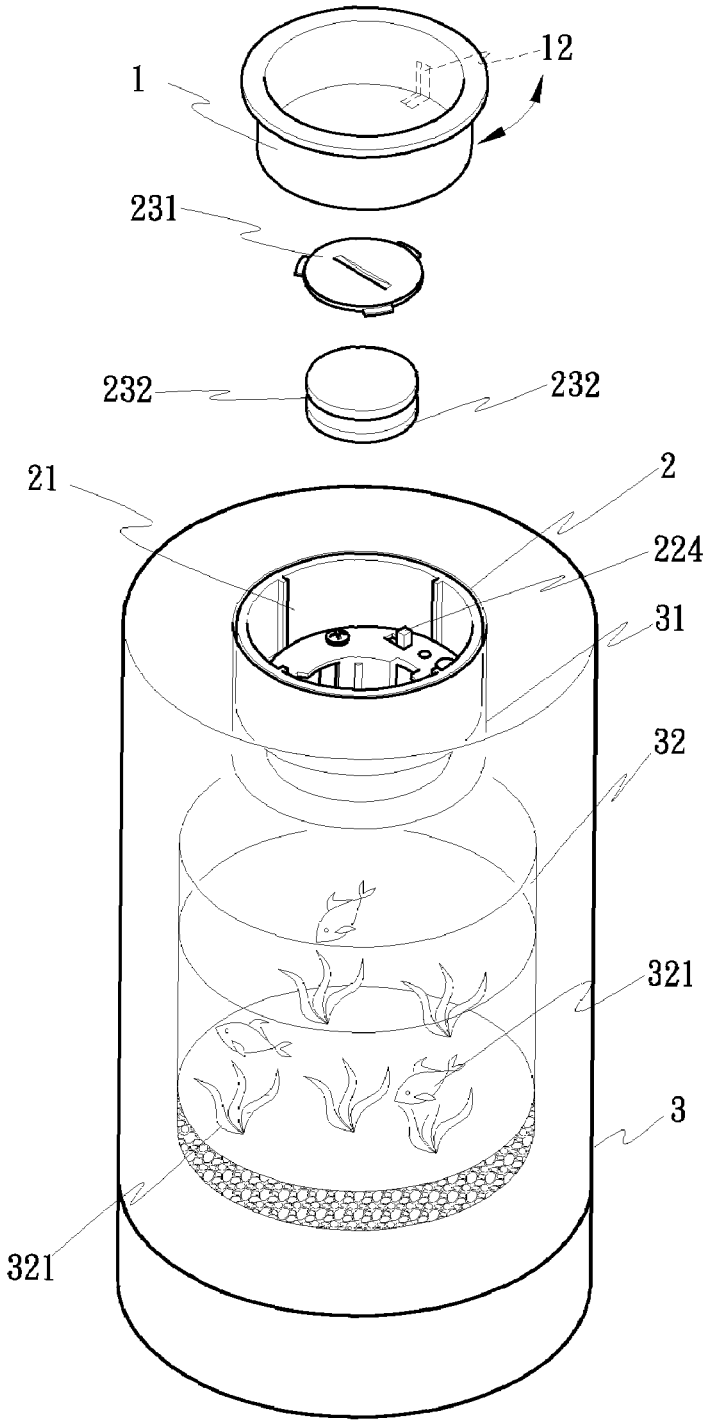
FIG. 2 is an exploded view of a part of the present invention.
Figure 3:
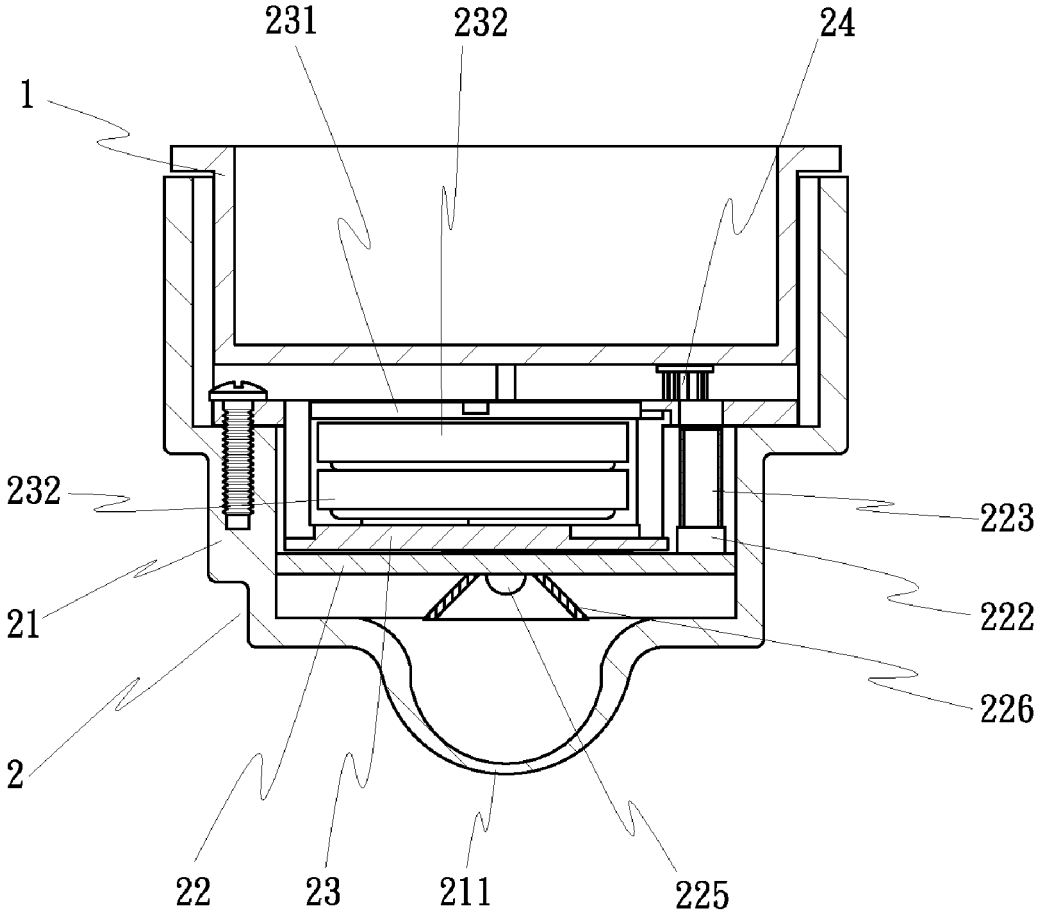
FIG. 3 is a sectional view showing the combination of a cup and an electronic installation in the present invention.

Referring to FIGS. 1, 2, and 3, a preferred embodiment of an electronic candleholder of the present invention includes a cup 1, a set of electronic installation 2, and a candleholder 3.

The cup 1 is provided at the top of the candleholder 3 for containing a proper amount of candle 11.

The electronic installation 2 disposed below the cup 1 provides a functional circuit comprised of multiple electronic devices to provide light emitting function when activated. A toggle switch 24 to be described below is disposed between the cup 1 and the electronic installation 2. As illustrated in the preferred embodiment, the electronic installation 2 includes a hollow case 21, a circuit board 22, a cell cabinet 23, and the toggle switch 24 in the form of an expansion press lever. The hollow case 21 accommodates the circuit board 22 and the cell cabinet 23 and has its top end extending to create a larger gradation space for the placement of the cup 1 as illustrated in FIGS. 2 and 3. The bottom of the hollow case 21 is a light permeable part 211 as illustrated in FIG. 3 for the light to pass and diffuse through it. The light permeable part 211 may be a convex with a thinner central part to achieve the astigmatism effects similar to refraction caused by a concave lens when the light passes through it.

The circuit board 22 relates to a functional circuit comprised of selected electronic devices. The functional circuit when conducted produces light emitting effects. In practice, a conductor plate 221 functioning as a switch is disposed at the circuit board 22 and incorporated with a photosensitive switch 222 and a corresponding mask 223 while a light emitting device (e.g., an electric bulb or a light emitting diode) 225 covered up with a reflective cover 226 is disposed at the lower end of the circuit board 22.

The cell cabinet 23 is disposed in the electronic installation 2 to accommodate one or a plurality of cells 232 and has its upper end provided with a lid 231 to cover up the cell cabinet 23.

Essentially, the functional circuit in the electronic installation 2 is activated in two phases: phase one conduction through the toggle switch 24 and phase two conduction through the photosensitive switch 222. The functional circuit is closed only when both phase one conduction and phase two conduction are completed, as described below.

The toggle switch 24 is made in a form of an expansion press lever as illustrated in the preferred embodiment. The lever protrudes at a selected location on the cell cabinet 23 corresponding to the conductor plate 221 of the circuit board 22. When the lever of the toggle switch 24 is pressed, it compresses on the conductor plate 221 to complete phase one conduction, i.e., the standby status, for the functional circuit of the electronic installation 2.

Figure 4:
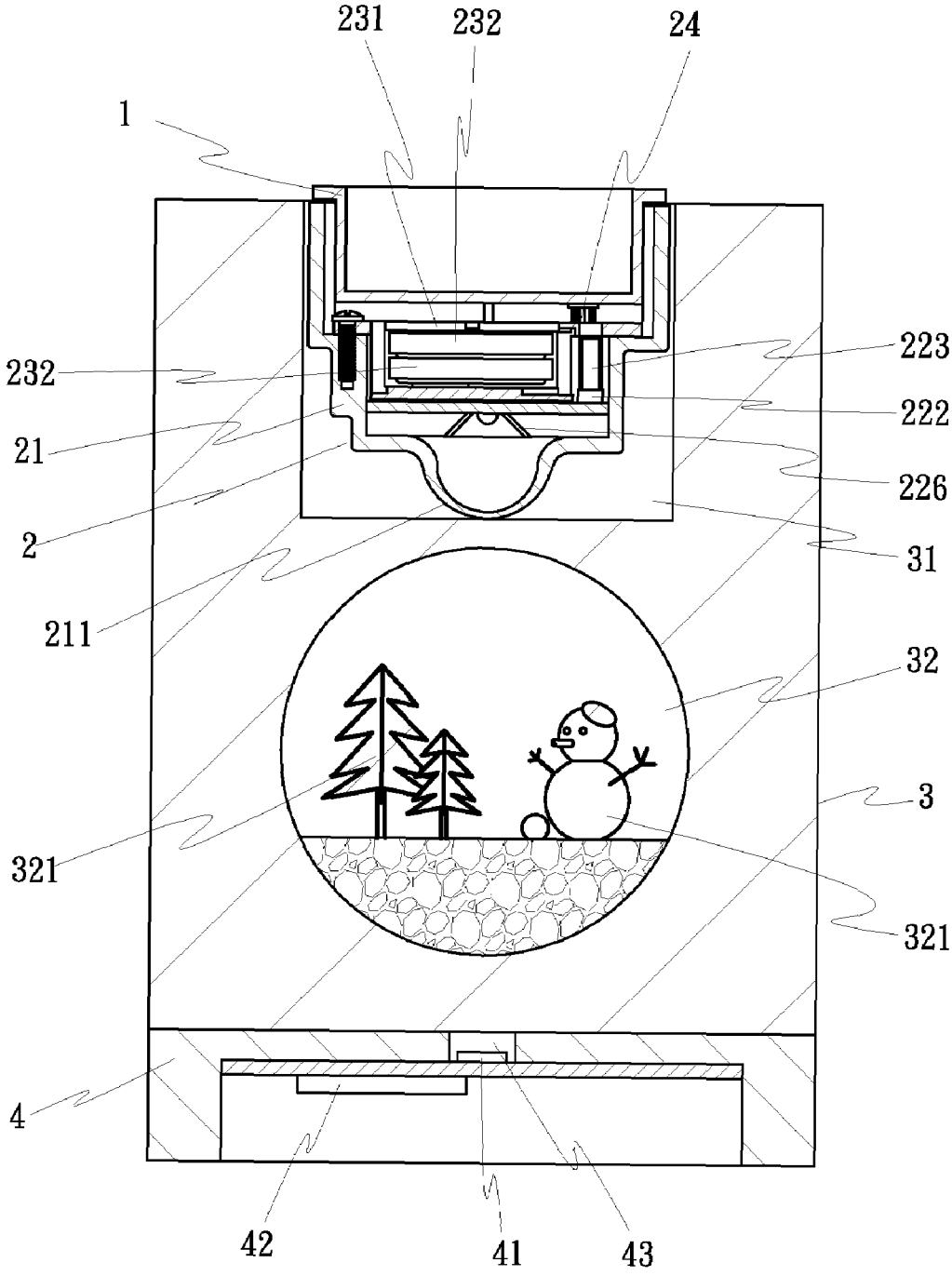
FIG. 4 is a sectional view showing an assembly of a preferred embodiment of the present invention.
Figure 5:
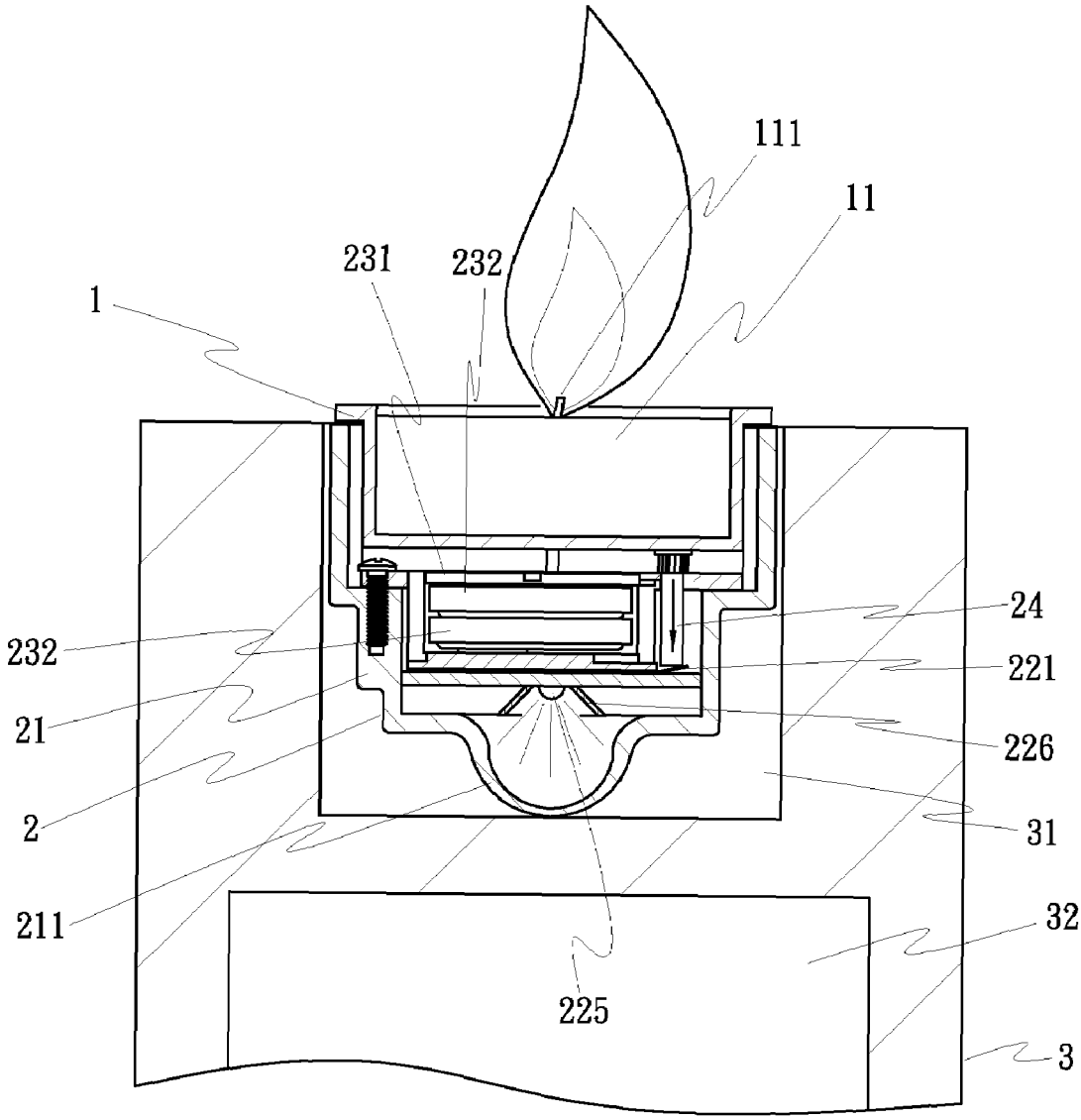
FIG. 5 is a schematic view showing phase one conduction status of the present invention when the cup presses a toggle switch.
Figure 6:
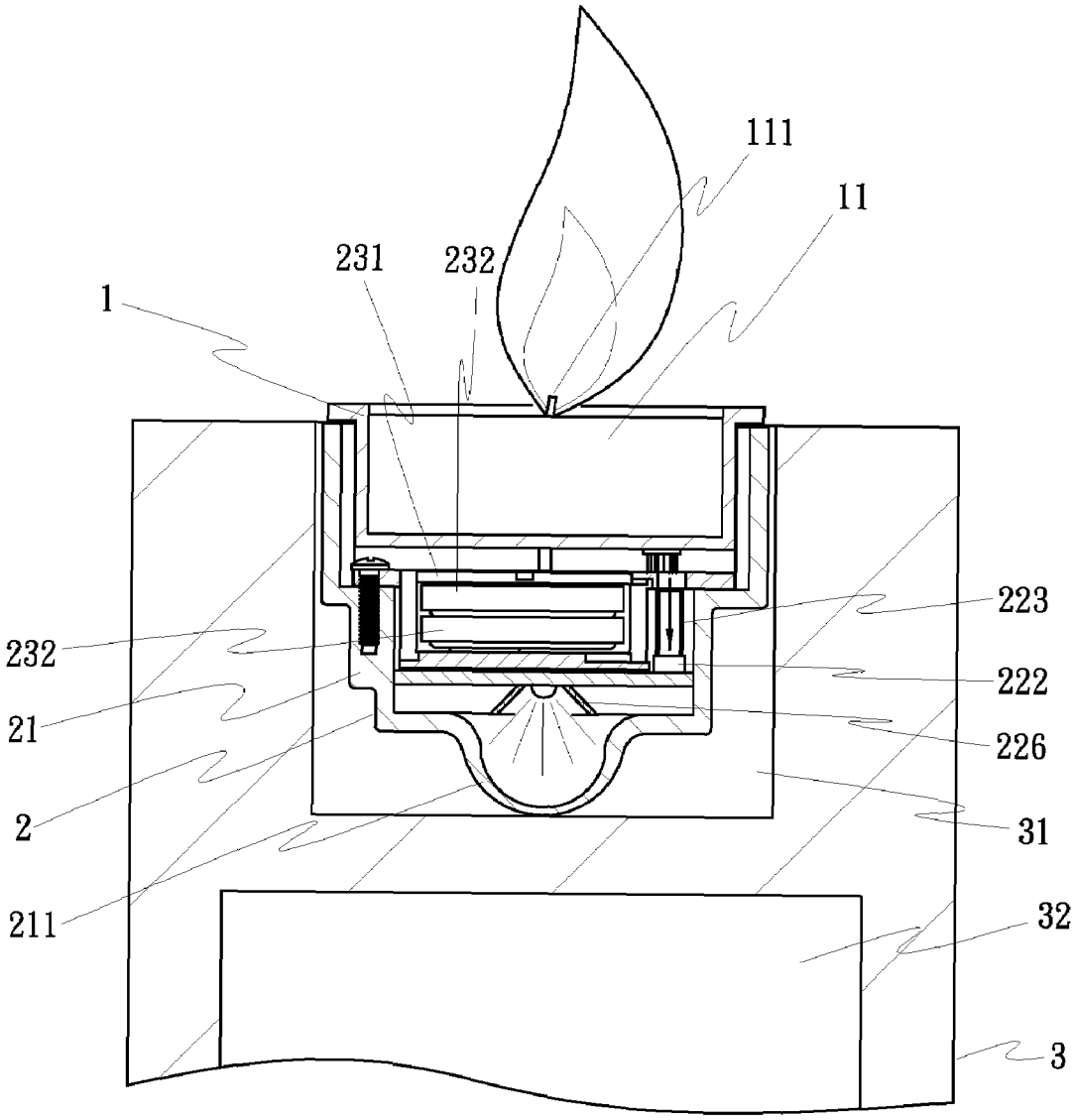
FIG. 6 is a schematic view showing the status of completion of phase two conduction of the present invention upon activating a photosensitive switch by lighting the candle.
Figure 8:
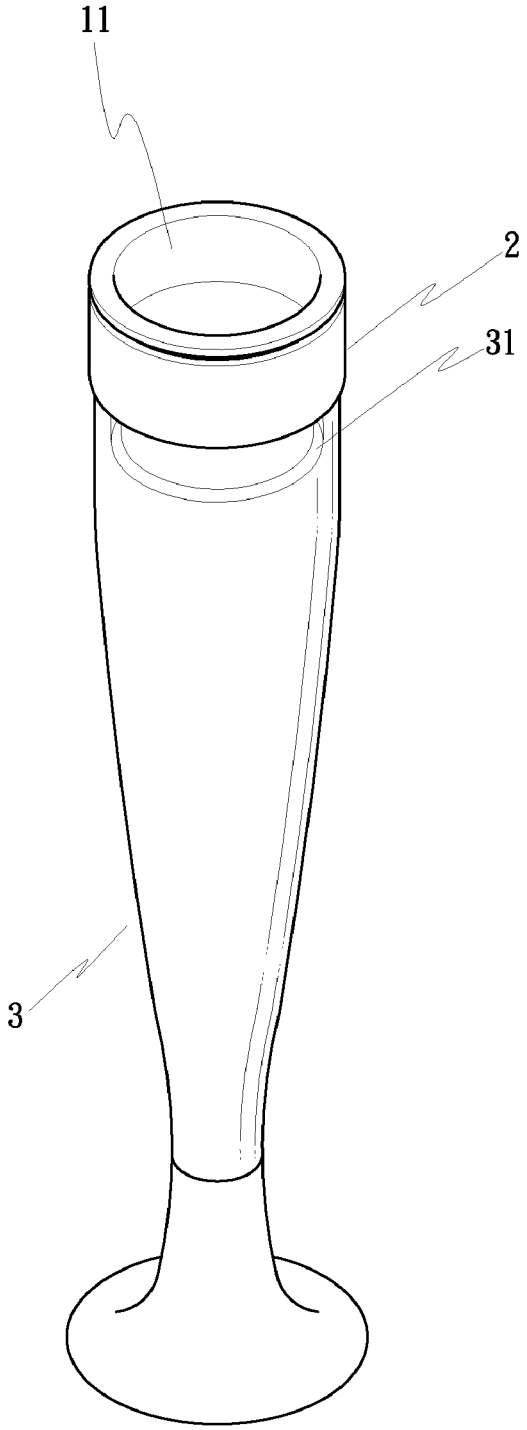
FIG. 8 is a schematic view showing another preferred embodiment of the present invention in an alternative style.

The candleholder 3 is a hollow holder which is fully or partially transparent or translucent with its shape not limited to any particular shape as it may have a cylindrical shape as illustrated in FIG. 1, a cup shape as illustrated in FIG. 4 or 8, a polygonal cylinder shape, a spherical shape, a polygonal sphere, or any other regular or irregular geometric shape as applicable. The material of the candleholder 3 is also not restricted as it may be made of ceramic, glass, colored glass, crystal, stone, metal, plastic, or wax material or any combination of them as desired. A cavity 31 is disposed on the top of the candleholder 3 to accommodate the cup 1 and the electronic installation 2. The candleholder 3 also contains one or a plurality of hollow parts for the placement of various decoration items 321, e.g., miniature topic figures, landscape and aquarium items. The area between the hollow part 32 and the cavity 31 may be made light permeable to allow the light to project from the cavity 31 into the hollow part 32. The lower end of the candleholder 3 is incorporated with a base 4.

The application of the photosensitive switch 222 and its corresponding mask 223 is essentially for the purpose of completing phase two conduction of the functional circuit by allowing the light to pass through the mask 223 to activate the photosensitive switch 222 when a wick 111 of the candle 11 is lighted. The light-emitting device 225 of the electronic installation 2 emits rainbow light to transmit through the interior of the candleholder 3 and reach the cavity 31, the hollow part 32 and the base 4 below. However, once the candle 11 is consumed to a certain extent and its weight is relieved from the cup 1, the expansion press lever 24 will be restored to its non-conducted status and the functional circuit will be automatically cut off.

Accordingly, once the cup 1 is loaded with a proper amount of candle 11, it puts extra weight to the cup 1 to trigger the toggle switch 24 for automatically completing phase one conduction of the functional circuit of the electronic installation 2 since the cup 1 is located over the candleholder 3 and the toggle switch 24 is disposed between the cup 1 and the electronic installation 2. Upon completing phase one conduction, the candleholder 3 is in a standby status, and phase two conduction for the functional circuit is subsequently completed when the photosensitive switch 222 is activated. Once the candle 11 is consumed to a certain extent, the weight of the candle 11 is relieved from the cup 1 to force the toggle switch 24 to return to its non-conducted status and automatically cut off the functional circuit. Therefore, the present invention allows firm control of the on/off timing without relying upon manual operation.

According to the present invention, the light emitted from the electronic installation 2 is capable of transmitting into the interior of the candleholder below since both of the cup 1 and the electronic installation 2 are provided over where the candleholder 3 is located. The projection of the light source is in the same desirable direction with the candlelight to shine brilliantly against each other, thus making the light better coordinated and more attractive.

Figure 7:
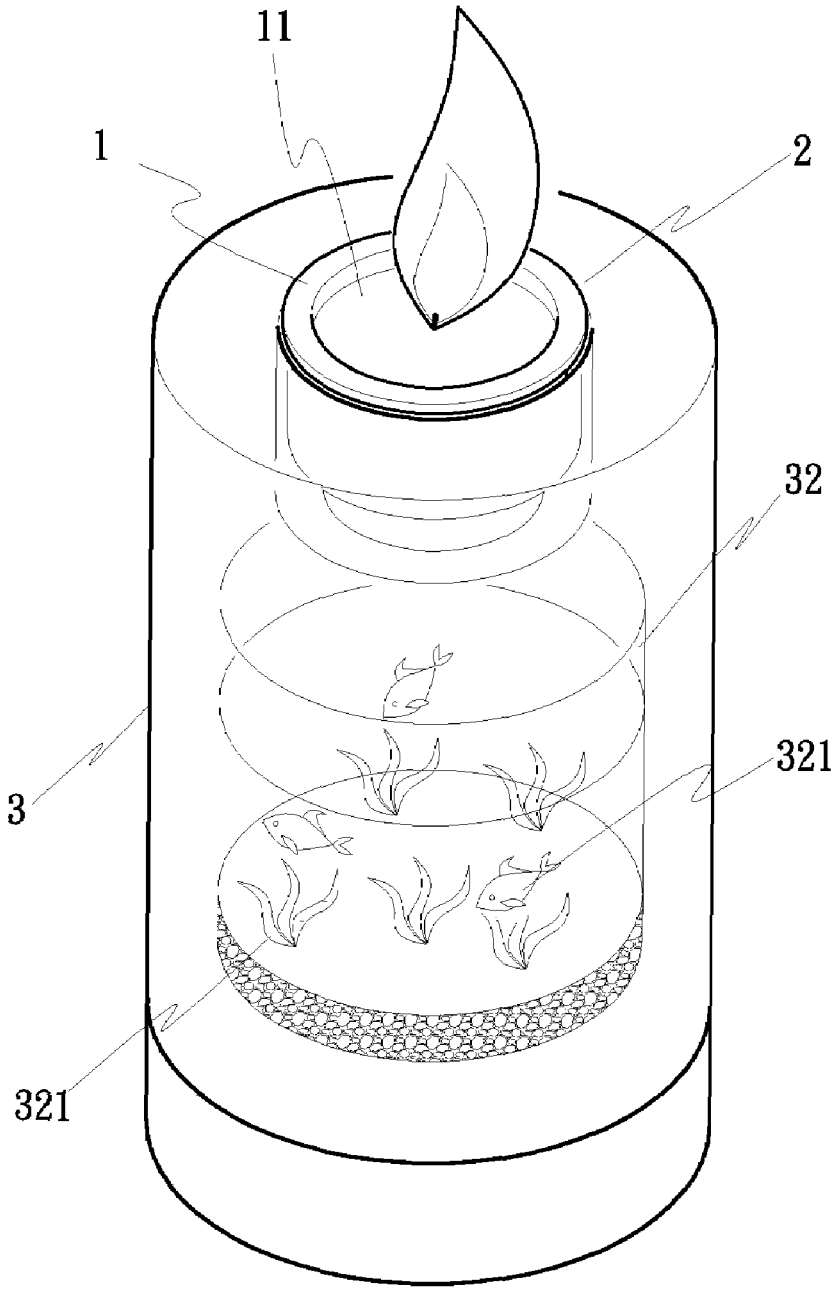
FIG. 7 is a schematic view showing a preferred embodiment of the present invention in operation.

As illustrated in FIGS. 1, 2 and 7, a slide switch 224 is further adapted in parallel with the photosensitive switch 222 of the electronic installation 2 to serve as another switch for phase two conduction for the functional circuit. The slide switch 224 shown is a handle shape and is secured to a slot 12 preset in relation to the cup 1. When the cup 1 is turned, the slide switch 224 is driven to activate the on/off operation of the electronic installation 2.

Upon completing phase one conduction for the functional circuit by activating the toggle switch 24 by filling the cup 1 with a proper amount of candle 11, either the photosensitive switch 222 or the slide switch 224 can be activated to complete phase two conduction for starting up the electronic installation 2.

As illustrated in FIG. 4, the present invention produces audio and video effects at the same time. To achieve this purpose, a loudspeaker 42 is further disposed in the base 4 located below the candleholder 3 with the on/off operation of the loudspeaker 42 controlled by another set of photosensitive device 41 or manual switch (not illustrated). The photosensitive device 41 is installed in a light permeable hole 43 (which may be inserted with a corresponding mask) for the light transmission downward to automatically activate the loudspeaker 42 to play music or give various tones as desired.

As described above, the application of the present invention is essentially achieved by having the toggle switch 24 to function as a main switch for the functional circuit of the electronic installation 2. Before the toggle switch 24 is activated, the electronic installation 2 is prevented from being activated even if the photosensitive switch 222 or the slide switch 224 is already activated. The form of the toggle switch 24 is not restricted to that of the expansion press lever; any switch that is capable of controlling the conduction status by changed weight of the cup may be applied to an embodiment of the present invention.

Furthermore, the light permeable part 211 on the bottom of the hollow case 21 projects the light into the transparent or translucent candleholder 3 and reflect the light on a decoration item 321 to provide the brilliant shining in the same direction as the light from the candlelight. Accordingly, the present invention helps project the light with better coordination and more attractive results to improve the visual effects presented by the decoration item 321, thus to create specially mixed effects of decoration and atmosphere.

What is claimed is:

1. An electronic candleholder comprising a cup for holding candle, a set of electronic installation disposed below the cup, and a candleholder, wherein the electronic installation comprises a functional circuit implemented with a circuit board; a hollow case; a cell cabinet, a light-emitting device; and a toggle switch in contact with the cup, wherein the toggle switch is an expansion press lever protruding from a location on the cell cabinet in relation to a conductor plate disposed on the circuit board;

the hollow case has a lower space, in which the circuit board and the cell cabinet are accommodated, and an upper space, in which the cup is accommodated;

the circuit board is incorporated with a photosensitive switch and a corresponding mask to control a phase two conduction of the functional circuit; and the light-emitting device is disposed below the hollow case; and the candleholder comprises a hollow holder having at its top disposed with a cavity to accommodate the cup and the electronic installation, wherein when the cup is loaded with a certain amount of candle, the toggle switch will be pressed down by the cup to complete a phase one conduction for the functional circuit of the electronic installation, placing the candleholder in a standby mode; and when the candle is depleted, the toggle switch will return to a non-conducted status and automatically cut off the functional circuit.

2. An electronic candleholder of claim 1, wherein a slide switch is installed in parallel with the photosensitive switch of the electronic installation so as to operate as an alternative on/off switch to control the phase two conduction for the functional circuit;

wherein the slide switch is made in a form of a handle inserted into a slot at a corresponding location on the bottom side of the cup so that the on/off operation of the slide switch is achieved by turning the cup.

3. An electronic candleholder of claim 1, wherein a reflective cover is provided surrounding the light-emitting device.

4. An electronic candleholder of claim 1, wherein a bottom portion of the hollow case is light permeable.

5. An electronic candleholder of claim 4, wherein the light permeable bottom portion of the hollow case has a transparent spherical surface and is gradually thinner toward a center thereof.

6. An electronic candleholder of claim 1, wherein the photosensitive switch is automatically activated to close the functional circuit when the candle is lighted.

7. An electronic candleholder of claim 1, wherein the candleholder is fully or partially transparent or translucent.

8. An electronic candleholder of claim 1, wherein at least one hollow part is disposed below the cavity of the candleholder to each accommodate at least one decoration item.

9. An electronic candleholder of claim 1, wherein a base is provided below the candleholder.

10. An electronic candleholder of claim 9, wherein a loudspeaker is disposed in the base and the on/off operation of the loudspeaker is controlled by a photosensitive device or a manual switch.

* * * * *